US008789552B2

(12) United States Patent
Weigen

(10) Patent No.: US 8,789,552 B2
(45) Date of Patent: Jul. 29, 2014

(54) ANTI-SIPHON DEVICE FOR A FLUSH VALVE

(75) Inventor: Chen Weigen, Shanghai (CN)

(73) Assignee: Shanghai Kohler Electronics, Ltd., Shanghai (CN)

( * ) Notice: Subject to any disclaimer, the term of this patent is extended or adjusted under 35 U.S.C. 154(b) by 658 days.

(21) Appl. No.: 12/303,591

(22) PCT Filed: Jun. 1, 2007

(86) PCT No.: PCT/IB2007/001460

§ 371 (c)(1),
(2), (4) Date: Feb. 20, 2009

(87) PCT Pub. No.: WO2007/141621

PCT Pub. Date: Dec. 13, 2007

(65) Prior Publication Data

US 2010/0043890 A1 Feb. 25, 2010

(30) Foreign Application Priority Data

Jun. 8, 2006 (CN) ..... 2006 2 0042501 U

(51) Int. Cl.
*F16K 24/02* (2006.01)
*E03C 1/10* (2006.01)

(52) U.S. Cl.
USPC ..... 137/217

(58) Field of Classification Search
CPC ..... F16K 24/02; E03C 1/122; E03C 1/10
USPC ..... 137/215, 217, 218
See application file for complete search history.

(56) References Cited

U.S. PATENT DOCUMENTS

| | | | | | |
|---|---|---|---|---|---|
| 2,189,694 | A | * | 2/1940 | Work | 137/218 |
| 2,940,464 | A | * | 6/1960 | Moen | 137/218 |
| 3,011,512 | A | * | 12/1961 | Moen | 137/218 |
| 3,171,423 | A | * | 3/1965 | Dillon | 137/218 |
| 3,636,968 | A | * | 1/1972 | Tine | 137/102 |
| 3,747,621 | A | * | 7/1973 | Tine | 137/218 |
| 3,818,929 | A | | 6/1974 | Braukmann | |
| 3,906,987 | A | * | 9/1975 | Rushforth et al. | 137/218 |

(Continued)

FOREIGN PATENT DOCUMENTS

| | | |
|---|---|---|
| CA | 2363744 | 5/2003 |
| CN | 1749493 A | 3/2006 |
| CN | 1761792 A | 4/2006 |

OTHER PUBLICATIONS

European Search Report mailed Nov. 23, 2012 in European Application No. 07734746.6.

(Continued)

*Primary Examiner* — Craig Schneider
(74) *Attorney, Agent, or Firm* — Foley & Lardner LLP

(57) ABSTRACT

An anti-siphon device for a flush valve having an air-inlet sealing diaphragm, a diaphragm bracket with an air inlet, a flex sleeve, a venting bracket, and an offsetting spring. The deformation power of the air-inlet sealing diaphragm is comparatively small. When compared with existing anti-siphon reflux devices, this anti-siphon device has a very low current pressure loss and can prevent leaking. When the anti-siphon device is applied in heating and plumbing devices, such as a flush valve, the current pressure can be retained and thus satisfactory flush effect is achieved.

20 Claims, 2 Drawing Sheets

(56) References Cited

U.S. PATENT DOCUMENTS

| | | | |
|---|---|---|---|
| 4,669,497 | A | 6/1987 | Tenhengel |
| 4,726,390 | A | 2/1988 | Franklin |
| 6,648,003 | B2 | 11/2003 | Weber et al. |
| 2003/0024569 | A1 | 2/2003 | Weber et al. |
| 2005/0133754 | A1 | 6/2005 | Parsons et al. |

OTHER PUBLICATIONS

European Search Report EP07734747, search completed on Oct. 18, 2012 (7 pgs).

International Search Report; PCT/IB2007/001460, Nov. 22, 2007.

* cited by examiner

ANTI-SIPHON DEVICE FOR A FLUSH VALVE

FIELD OF INVENTION

The present invention relates to an anti-siphon device for a flush valve, which can be widely applied in heating and plumbing industries.

BACKGROUND OF THE INVENTION

In the water supply system, vacuum-type situations can easily occur due to water supply cutoff or many other reasons. Additionally, when the pressure is lower than the atmospheric pressure, the result may be siphon and liquid reflux. When the siphon and liquid reflux is serious, it can pollute the whole water supply system. Currently, to achieve the anti-siphon effect and to prevent the system from leaking, some reflux devices use a unidirectional valve to activate a diaphragm for sealing the air inlet. However, this may result in a considerable loss in the current pressure of the system. The present invention helps to solve the problem of current pressure loss, and realizes an effective anti-siphon effect.

SUMMARY OF THE INVENTION

The invention is directed to an anti-siphon device for a flush valve. The device comprises an air-inlet sealing diaphragm, a diaphragm bracket with an air inlet, a wave flex sleeve, a venting bracket, and an offsetting spring. The air-inlet sealing diaphragm has a comparatively small deformation power. The deformation power of the air-inlet sealing diaphragm is less than the joint deformation power of the wave flex sleeve and the offsetting spring. The wave flex sleeve and the air-inlet sealing diaphragm are around the diaphragm bracket, which can move upward and downward along the venting bracket. The venting bracket realizes airing between the outside and the inner side of the pipelines.

When there is no water flow, the air-inlet sealing diaphragm is freely extended, and the air inlet remains open. When there is a certain amount of water current, the air-inlet sealing diaphragm is deformed it moves to seal the air inlet to prevent leaking. When the water flow in the pipeline system is too small to push the air-inlet sealing diaphragm downward to seal the air inlet, the elasticity of the offsetting spring causes the diaphragm bracket to move downward slightly. This results in the flow passage to be comparatively small, while the flow area of the lower pipelines is far bigger than that. This prevents overflow in the pipeline and water won't flow out through the air inlet.

Compared with existing anti-siphon reflux devices, this apparatus has a relatively small loss of current pressure; meanwhile, leaking is effectively prevented. When it is applied in heating and plumbing devices, such as a flush valve, the current pressure can be retained and thus satisfactory flush effect is achieved.

It is the intention of at least an embodiment of the invention to provide an anti-siphon device comprising: a fluid passageway having a fluid inlet and a fluid outlet; at least one air inlet; a venting bracket fixedly located within the fluid passageway, the venting bracket providing a first portion of an air passage which is in fluid communication with the at least one air inlet; a diaphragm bracket in sliding engagement with the venting bracket which provides a second portion of the air passage which is in fluid communication with the at least one air inlet through the first portion of the air passage; a resiliently deformable diaphragm biasedly mounted on the diaphragm bracket; at least one air opening provided in the diaphragm bracket adjacent to the sealing diaphragm; wherein in a sealed position, no fluid flows through the fluid inlet, the sealing diaphragm is disposed against an inlet seal surface, and fluid communication is open through at least one air opening in the diaphragm bracket between the fluid outlet and that at least one air inlet; wherein in a unsealed position, the sealing diaphragm is disposed away from the inlet seal surface and fluid flows through the fluid inlet, and the sealing diaphragm is deformed to restrict fluid communication through at least one air opening in the diaphragm bracket between the fluid outlet and the at least one air inlet.

DESCRIPTION OF THE PREFERRED EMBODIMENTS

Figure 1:
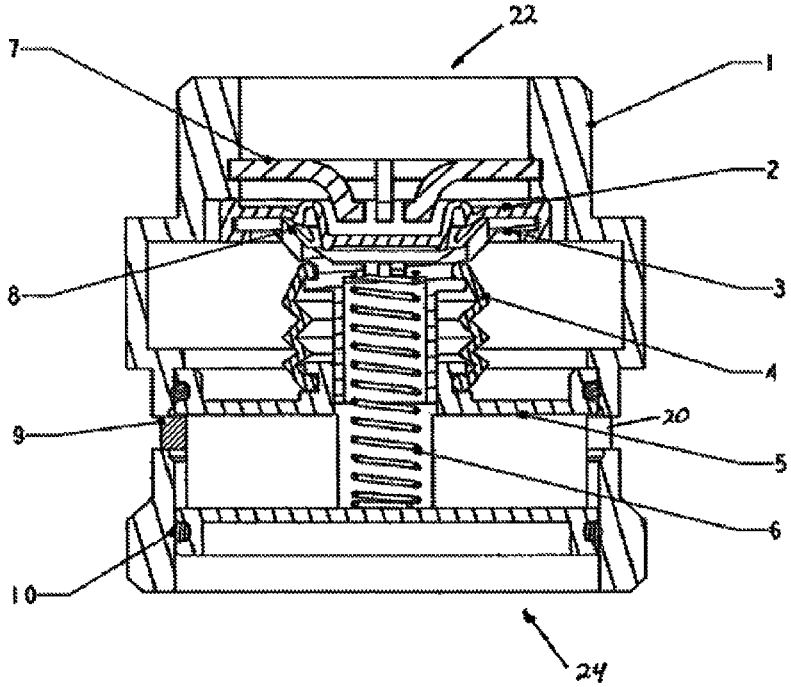
FIG. 1 shows the structure of the anti-siphon device.

As shown in FIG. 1, the anti-siphon reflex device includes a fluid passageway (1) with at least one air passage (20) and a fluid inlet (22) and fluid outlet (24), air-inlet sealing diaphragm (2), diaphragm bracket (3) with an air hole (8), flex sleeve (4), venting bracket (5), offsetting spring (6), limit ring (7), pin (9), and O-shaped circle or O-ring (10). The flex sleeve (4) preferably provides a seal between the venting bracket (5) and diaphragm bracket (3). The deformation power of the sealing diaphragm is comparatively small, and is smaller than the joint deformation power of the flex sleeve (4) and the offsetting spring. The deformation power of the flex sleeve (4) is also very small. An end of the flex sleeve (4) is preferably located around a bottom portion of the diaphragm bracket (3). The bottom portion of the diaphragm bracket (3) preferably slides upward and downward within an upper portion of the venting bracket (5). The venting bracket (5) realizes airing or releases air to the outside of the fluid passageway (1). The diaphragm bracket (3) supports the air-inlet sealing diaphragm (2). The pin (9) is used to position the venting bracket (5). The limit ring (7) limits movement of the air-inlet sealing diaphragm (2). When there is negative pressure in the fluid passageway (1), the limit ring (7) may prevent the air-inlet sealing diaphragm (2) from reverse suction or too much deformation. The air-inlet sealing diaphragm (2) can deform and move to seal the air hole (8) in the sealing diaphragm bracket (3).

When there is no water supply passing through the anti-siphon device, the offsetting spring (6) raises the diaphragm bracket (3). Here the air-inlet sealing diaphragm (2) is freely extended. The air outside the fluid passageway (1) may enter the air passage (20) of the venting bracket (5) and pass through the diaphragm bracket (3) and the air hole (8) in the diaphragm bracket (3) to be in fluid communication with the inner part of fluid passageway (1), so that possible vacuum is broken and prevents siphon.

Figure 2:
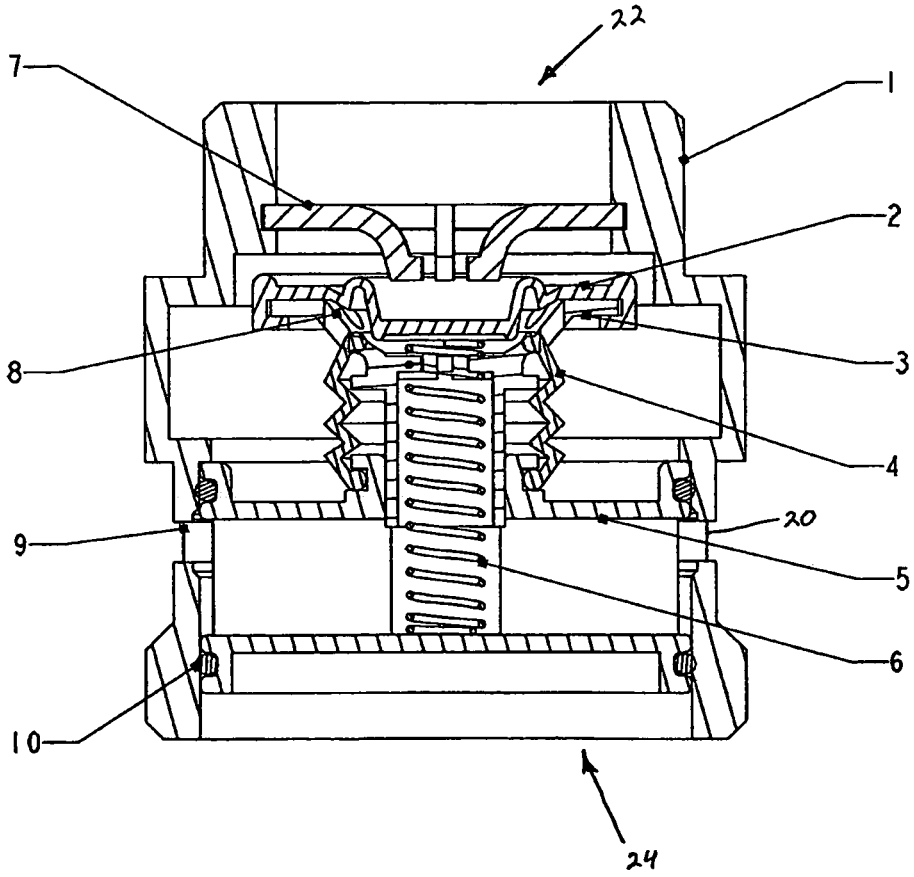
FIG. 2 shows a cross-sectional view of the structure of the anti-siphon device when there is water flow.

As shown in FIG. 2, when there is water flow through the fluid passageway (1), suppose the amount flow and fluid pressure is too small to push the air-inlet sealing diaphragm (2) to deform and move downward to completely seal the air inlet (8). Here, due to the elasticity of the offsetting spring (6), the diaphragm bracket (3) moves downward slightly, and the flow passage is comparatively small, while the flow area of the lower pipeline is far bigger than the flow passage around the diaphragm bracket (3). Therefore, there won't be overflow in the pipeline and water won't flow out through the air inlet (8).

As the fluid flows faster through the fluid passageway (1), the pressure on the air-inlet sealing diaphragm (2) increases, and causes the air-inlet sealing diaphragm (2) to deform and move downward to seal the air inlet (8) completely. When the fluid pressure and speed reaches a certain degree, the fluid force against the air-inlet sealing diaphragm (2) overcome the deformation power of the offsetting spring (6) and flex sleeve (4), so that the air-inlet sealing diaphragm (2) and diaphragm bracket (3) move further downward into the fluid passageway (1). The water passage increases, and the flow capacity increases as the air-inlet sealing diaphragm (2) moves further downward. When the deformation power of the air-inlet sealing diaphragm (2) is very small, there is very little fluid pressure, and the air-inlet sealing diaphragm (2) can rapidly close the air inlet (8) to prevent leaking.

By setting a proper elasticity for the offsetting spring (6) and a sufficiently small deformation power for the flex sleeve (4), the fluid pressure necessary to overcome the spring's elasticity and the deformation power of the flex sleeve (4) will be small.

Fluid flowing through the anti-siphon device enters the inlet (22), passes through the limit ring (7), and flows around the air-inlet sealing diaphragm (2), the fluid flows around the venting bracket (5) and out through the fluid outlet (24).

Although the present invention has been shown and described herein by way of a preferred embodiment, it is understood that the invention may be modified without departing form the scope and spirit of the invention as defined in the following claims.

What is claimed is:

1. An anti-siphon device comprising:

a fluid passageway having a fluid inlet and a fluid outlet;

at least one air inlet;

a venting bracket fixedly located within the fluid passageway, the venting bracket providing a first portion of an air passage which is in fluid communication with the at least one air inlet;

a diaphragm bracket in sliding engagement with the venting bracket which provides a second portion of the air passage which is in fluid communication with the at least one air inlet through the first portion of the air passage;

a resiliently deformable diaphragm biasedly mounted on the diaphragm bracket;

at least one air opening provided in the diaphragm bracket adjacent to the diaphragm; and a flex sleeve disposed between the venting bracket and the diaphragm bracket;

wherein in a sealed position, no fluid flows through the fluid inlet, the diaphragm is disposed against a fluid inlet seal surface, and fluid communication is open through at least one air opening in the diaphragm bracket between the fluid outlet and the at least one air inlet;

wherein in a unsealed position, the diaphragm is disposed away from the fluid inlet seal surface and fluid flows through the fluid inlet, and the diaphragm is deformed to restrict fluid communication through at least one air opening in the diaphragm bracket between the fluid outlet and the at least one air inlet.

2. An anti-siphon device of claim 1, wherein the flex sleeve surrounds a lower portion of the diaphragm bracket, and a first end of the flex sleeve is sealed against the diaphragm bracket and a second end of the flex sleeve is sealed against the venting bracket.

3. The anti-siphon device of claim 1, further comprising a limit ring disposed in the fluid inlet adjacent to the diaphragm.

4. The anti-siphon device of claim 3, wherein the limit ring is shaped and configured to support the diaphragm as the diaphragm is forced against the limit ring in a backflow condition.

5. An anti-siphon device of claim 1, wherein the flex sleeve surrounds a lower portion of the diaphragm bracket, and a first end of the flex sleeve is sealed against the diaphragm bracket and a second end of the flex sleeve is sealed against the venting bracket.

6. The anti-siphon device of claim 1, wherein the at least one air inlet is configured to allow entry of air outside the fluid passageway to be in fluid communication with an inner part of the fluid passageway.

7. The anti-siphon device of claim 1, wherein in the sealed position, fluid communication is open between the fluid passageway and the at least one air inlet to prevent a siphon condition.

8. An anti-siphon device, comprising:

a fluid passageway configured to communicate fluid from a fluid inlet to a fluid outlet;

an air passageway configured to communicate air from outside the fluid passageway to inside the fluid passageway;

a diaphragm disposed inside the fluid passageway and configured to slide to and from an extended position relative to the fluid passageway; and a flexible sleeve configured to bias the diaphragm toward the extended position and seal a portion of the device;

wherein when the diaphragm is in the extended position, water does not flow through the fluid passageway; and wherein the diaphragm is configured to deform into and out of a sealed position in which air does not flow through the air passageway.

9. The anti-siphon device of claim 8, wherein the diaphragm is configured to slide and deform due to fluid flow.

10. The anti-siphon device of claim 8, wherein when the diaphragm is in the extended position, the diaphragm is not deformed into the sealed position.

11. The anti-siphon device of claim 10, wherein when the diaphragm is deformed into the sealed position, the diaphragm is not in the extended position.

12. The anti-siphon device of claim 8, further comprising:

a diaphragm bracket coupled to the diaphragm and disposed inside the fluid passageway, and a spring coupled to the diaphragm;

wherein when there is no fluid flow through the passageway, the spring is configured to slide the diaphragm bracket and the diaphragm to the extended position.

13. The anti-siphon device of claim 12, wherein the diaphragm bracket comprises an air inlet forming a first portion of the air passageway; and wherein when the diaphragm is deformed into the sealed position, the diaphragm seals the air inlet.

14. The anti-siphon device of claim 13, further comprising a venting bracket coupled to and disposed inside the fluid passageway;

wherein the diaphragm bracket is in sliding engagement with the venting bracket, the venting bracket forms a second portion of the air passageway, and the second portion of the air passageway is open to air outside the fluid passageway.

15. The anti-siphon device of claim 14, wherein the sleeve forms a seal between the diaphragm bracket and the venting bracket.

16. The anti-siphon device of claim 8, wherein the diaphragm is configured to slide axially away from the extended position when the biasing force of the sleeve is overcome by an opposing force of the fluid on the diaphragm.

17. The anti-siphon device of claim 8, wherein the diaphragm is configured to slide to and from the extended position independent of deforming into and out of the sealed position.

18. The anti-siphon device of claim 8, wherein the extended position is different than the sealed position.

19. The anti-siphon device of claim 8, wherein the diaphragm is configured to seal the fluid passageway in the extended position.

20. The anti-siphon device of claim 8, wherein a diaphragm bracket comprises an air inlet forming a first portion of the air passageway, and wherein when the diaphragm is deformed into the sealed position, the diaphragm seals the air inlet.

* * * * *

UNITED STATES PATENT AND TRADEMARK OFFICE

CERTIFICATE OF CORRECTION

PATENT NO. : 8,789,552 B2
APPLICATION NO. : 12/303591
DATED : July 29, 2014
INVENTOR(S) : Weigen It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 781 days.

Signed and Sealed this
Eleventh Day of August, 2015

Michelle K. Lee

Michelle K. Lee
*Director of the United States Patent and Trademark Office*